US006626641B1

(12) United States Patent
Burns et al.

(10) Patent No.: US 6,626,641 B1
(45) Date of Patent: Sep. 30, 2003

(54) NOZZLE FOR TURBINE

(75) Inventors: Alton Burns, Friendswood, TX (US); Michael L. Macek, Friendswood, TX (US)

(73) Assignee: Alfred Conhagen, Inc., La Marque, TX (US)

( * ) Notice: Subject to any disclaimer, the term of this patent is extended or adjusted under 35 U.S.C. 154(b) by 103 days.

(21) Appl. No.: 09/695,640

(22) Filed: Oct. 24, 2000

(51) Int. Cl.[7] ..... F01D 9/04

(52) U.S. Cl. ..... 415/190; 415/189; 415/191; 415/193; 415/202; 415/209.2; 415/209.4; 29/888.021; 29/889.22

(58) Field of Search ..... 415/185, 189–191, 415/193, 202, 208.2, 209.1, 209.2, 209.3, 209.4, 1; 29/888, 888.021, 889.22

(56) References Cited

U.S. PATENT DOCUMENTS 1,697,174 A * 1/1929 Forner ..... 415/202
1,829,122 A * 10/1931 Wade ..... 415/208.3
3,836,281 A * 9/1974 Czuszak ..... 415/189
4,295,788 A 10/1981 Dussourd et al.
4,684,326 A 8/1987 Wassell et al.
5,259,727 A * 11/1993 Quinn ..... 415/190
6,416,277 B1 * 7/2002 Manges, Jr. ..... 415/189

FOREIGN PATENT DOCUMENTS

DE 2241788 A * 3/1974 ..... 415/202

* cited by examiner

*Primary Examiner*—Christopher Verdier
(74) *Attorney, Agent, or Firm*—John R Casperson

(57) ABSTRACT

A steam turbine of the type which incorporates a turbine case defining a plurality of passages having outlets opening through an inside end wall of the turbine case in a direction generally parallel to the turbine shaft, with nozzles positioned over the outlets to direct steam against the periphery of the turbine wheel, can be modified to a higher efficiency design. To perform the modification, the nozzles are removed, an arcuately shaped housing is positioned in covering relationship with the outlets, and an arcuately shaped louver is positioned so as to form an end wall of the housing. The louver has a plurality of vanes to direct the steam against the periphery of the turbine wheel to cause rotation of the turbine shaft and the housing forms a confined steam flow path from the outlets to the louver. The downstream turbine blading can be modified if desired.

4 Claims, 3 Drawing Sheets

NOZZLE FOR TURBINE

BACKGROUND OF THE INVENTION

This invention relates generally to turbines. In one aspect, the invention relates to steam turbines in which pressurized steam is employed to drive a turbine wheel.

A common type of steam turbine employs a plurality of circularly cross-sectioned nozzles circumferentially spaced around the interior of a turbine housing and oriented so as to drive the turbine wheel. The design is inherently inefficient but is widely used, because a turbine which employs drilled or pipe type nozzles is much less expensive to manufacture than a more efficient design which utilizes airfoils to distribute the steam against the wheel.

Converting these older units to a more efficient design would result in substantial savings in steam. For example, a modification to convert a unit from a drilled or pipe-type inlet system to an airfoil type inlet system could result in a 15% savings in steam consumption, while producing the same amount of power, with reductions up to 30% being possible under certain steam conditions. Because of the size of the units, a conversion to a more efficient design could result in savings on fuel costs on the order of $200,000 per year that the unit is operated.

It is an object of this invention to provide such a conversion that is cost effective to implement.

SUMMARY OF THE INVENTION

In one embodiment of the invention, there is provided a turbine which includes a turbine case, a turbine shaft, a turbine wheel, a louver, and a housing for connecting the louver to the turbine case. The turbine case has a first end wall, a second end wall, and a peripheral side wall connecting the first end wall and the second end wall. The turbine case defines a turbine chamber. The turbine shaft is rotatably mounted in the turbine case and extends between the first end wall and the second end wall of the turbine case. The turbine shaft has a longitudinal axis. The turbine wheel is attached to the turbine shaft and extends radially from the shaft. The turbine wheel is positioned in the turbine chamber between the first end wall and the second end wall of the turbine case. The turbine wheel has a turbine wheel periphery which is positioned adjacent to the peripheral sidewall of the turbine case. The turbine case defines a plurality of inlet ports opening through the first end wall to a location in the turbine chamber which is adjacent to the peripheral sidewall of the turbine case. The inlet ports open into the turbine chamber in a direction which is parallel to the longitudinal axis of the turbine shaft. The louver is arcuately shaped and is for directing fluid against the periphery of the turbine wheel so as to cause rotation of the turbine wheel. The adapter housing extends from the arcuately shaped louver to the first end wall of the turbine case and locates the arcuately shaped louver and forms a fluid flow path from the inlet ports to the arcuately shaped louver.

In another embodiment of the invention, there is provided an improvement to a process in which a flow of gas is introduced into a turbine case through a plurality of peripherally spaced passages formed by an end wall of the turbine case, the passages opening through the end wall of the case in a direction generally parallel to the turbine shaft. The improvement is provided by flowing the gas from the outlets of the passages into an arcuately shaped housing mounted in covering relationship with the outlets, and thence through a louver for impingement on the periphery of the turbine wheel.

In a further embodiment of the invention, there is provided a method for modifying a steam turbine of the type which incorporates a turbine case defining a plurality of passages having outlets opening through an inside end wall of the turbine case in a direction generally parallel to the turbine shaft, with nozzles positioned over the outlets to direct steam against the periphery of the turbine wheel. To perform the modification, the nozzles are removed, an arcuately shaped housing is positioned in covering relationship with the outlets, and an arcuately shaped louver is positioned so as to form an end wall of the housing. The louver has a plurality of vanes to direct the steam against the periphery of the turbine wheel to cause rotation of the turbine shaft and the housing forms a confined steam flow path from the outlets to the louver. Greater efficiency can be obtained by employing the louver instead of nozzles, and the invention thus provides a technique for modifying a common steam turbine design to provide a more efficient unit.

DETAILED DESCRIPTION OF THE INVENTION

Figure 1:
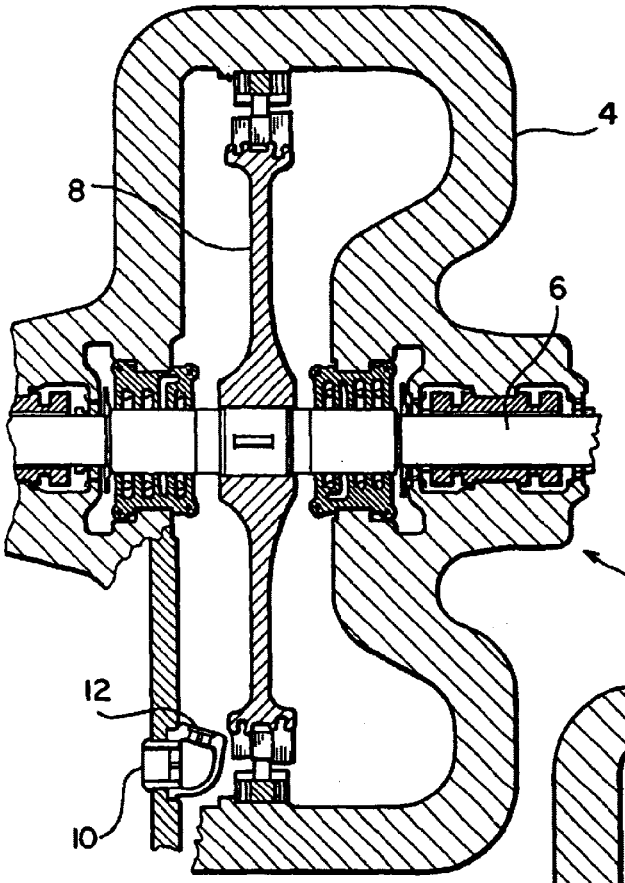
FIG. 1 (PRIOR ART)
FIG. 1 is a cross-sectional view of a prior art turbine to which the invention can be applied.

A prior art turbine 2 is shown in FIG. 1. The turbine 2 employs a turbine case 4, a turbine shaft 6, and a turbine wheel 8. Steam is admitted into the turbine case via a plurality of ports 10 and is directed against a periphery of the wheel via nozzles 12 to drive the shaft.

Figure 2:
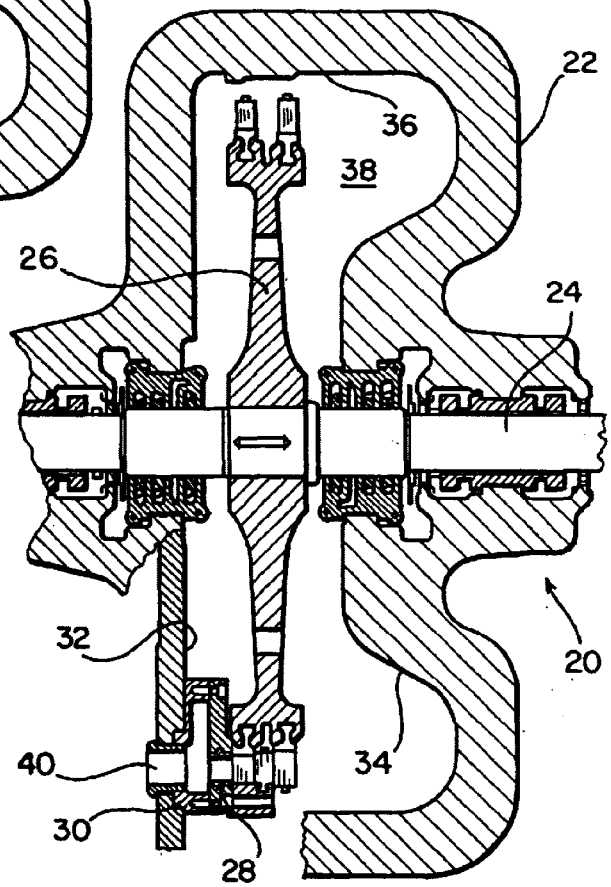
FIG. 2 is a cross sectional view of an embodiment of the invention.

FIG. 2 illustrates an embodiment of the invention. The turbine 20 includes a turbine case 22, a turbine shaft 24, a turbine wheel 26. However, instead of a nozzle 12, the invention employs a louver 28, and a housing 30 for connecting the louver to the turbine case. The turbine case has a first end wall 32, a second end wall 34, and a peripheral side wall 36 connecting the first end wall and the second end wall. The turbine case defines a turbine chamber 38. The turbine shaft is rotatably mounted in the turbine case and extends between the first end wall and the second end wall of the turbine case. The turbine shaft has a longitudinal axis. The turbine wheel is attached to the turbine shaft and extends radially from the shaft. The turbine wheel is positioned in the turbine chamber between the first end wall and the second end wall of the turbine case. The turbine wheel has a turbine wheel periphery which is positioned adjacent to the peripheral sidewall of the turbine case. The turbine case defines a plurality of inlet ports 40 opening through the first end wall to a location in the turbine chamber which is adjacent to the peripheral sidewall of the turbine case. (See also FIG. 4) The inlet ports open into the turbine chamber in a direction which is parallel to the longitudinal axis of the turbine shaft. The louver is arcuately shaped (See FIG. 5) and is for directing fluid against the periphery of the turbine wheel so as to cause rotation of the turbine wheel. The adapter housing extends from the arcuately shaped louver to the first end wall of the turbine case and locates the arcuately shaped louver and forms a fluid flow path from the inlet ports to the arcuately shaped louver.

Figure 3:
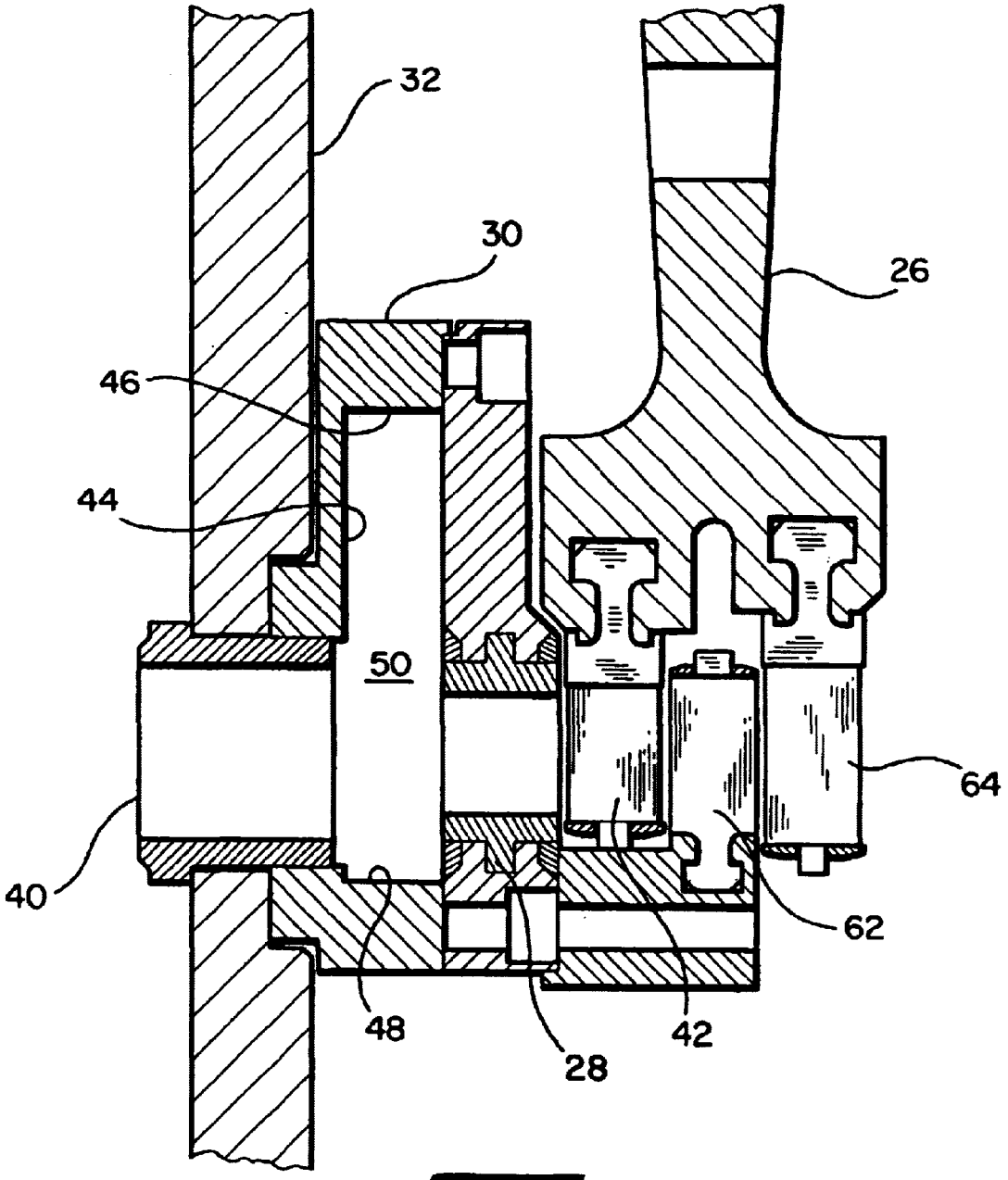
FIG. 3 is a detailed view of a portion of the invention as shown in FIG. 2.

With reference to FIG. 3, the periphery of the turbine wheel is formed by a first plurality of generally radially disposed blades 42 positioned to pass closely adjacent to the arcuately shaped louver during rotation of the turbine wheel so as to catch the force of the fluid exiting the arcuately shaped louver and rotate the turbine wheel. See also FIG. 6. The arcuately shaped louver preferably directs a fluid flow into the turbine chamber with a whirling component around the longitudinal axis of the turbine chamber. The arcuately shaped louver preferably directs fluid flow into the turbine chamber with a longitudinal component which is parallel to the longitudinal axis of the turbine chamber.

Figure 4:
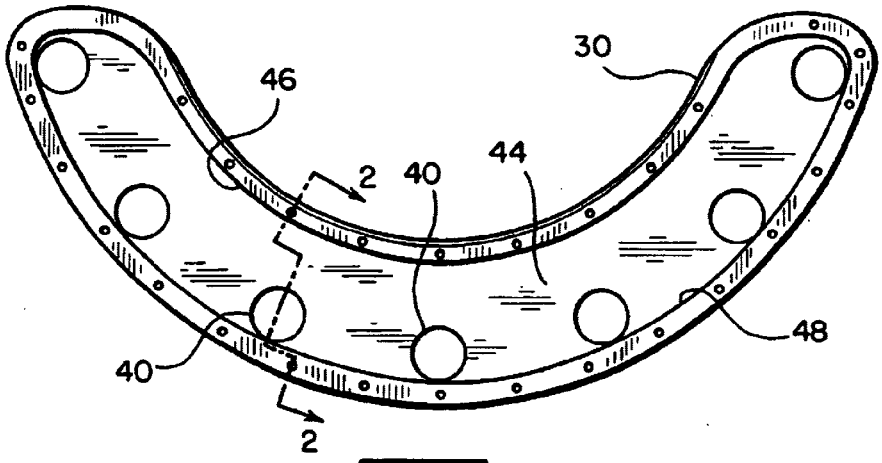
FIG. 4 is a plan view of a portion of the invention as shown in FIG. 2.
Figure 5:
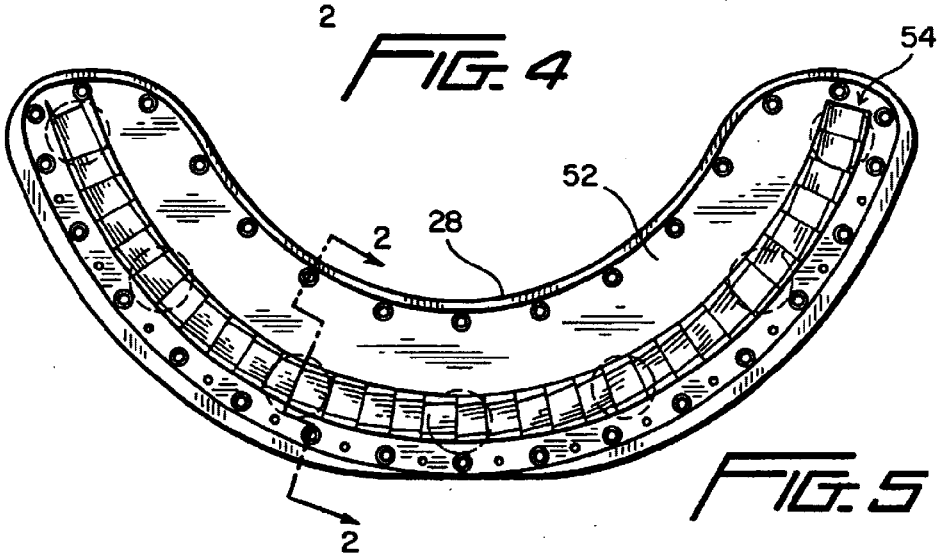
FIG. 5 is a plan view of another portion of the invention as shown in FIG. 2.
Figure 6:
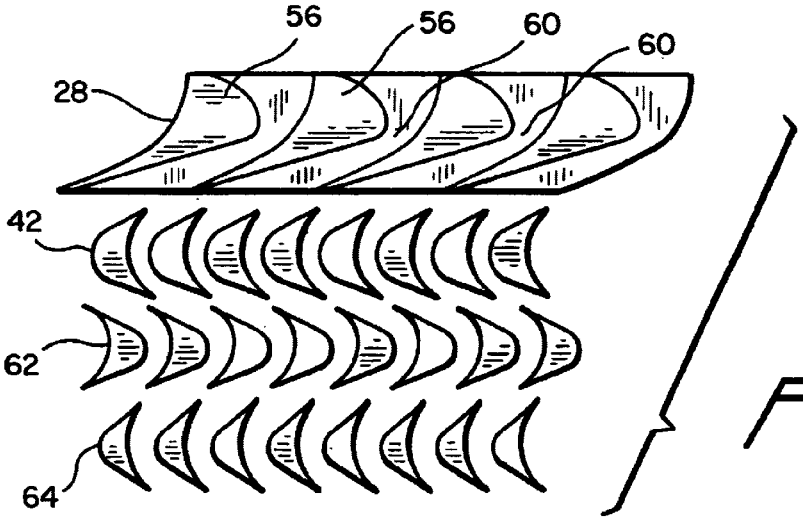
FIG. 6 is a schematic illustrating a blade configuration according to an embodiment of the invention.

With reference to FIGS. 3 and 4, the adapter housing preferably comprises an arcuately shaped trough having a bottom end wall 44 attached to the first end wall of the turbine case and positioned in covering relationship with the plurality of inlet ports. A pair of arcuately shaped trough side walls 46, 48 extend from the bottom end wall to the arcuately shaped louver. The inlet ports open into a chamber 50 defined by the bottom end wall, the side walls and the louver. The chamber forms the fluid flow path from the inlet ports to the arcuately shaped louver. With reference to FIGS. 5 and 6 the louver preferably comprises an arcuately shaped plate 52 which defines an arcuately shaped slot 54 and a plurality of airfoil blades 56 mounted across the slot. The plate is connected to the arcuately shaped trough side walls. The plurality of airfoil blades extends generally radially across the slot so as to define nozzles for fluid passage between the blades.

As best shown in FIG. 6, a first plurality of blades 42 on the periphery of the turbine wheel are preferably configured to reverse a direction of swirl of fluid flowing from the nozzles 60 defined between the blades 56 of the louver. A plurality of reversing blades 62 (see also FIG. 3) extend generally radially inwardly from the peripheral wall of the turbine case and are positioned closely adjacent to the first plurality of generally radially disposed blades 42 on the periphery of the turbine wheel. The first plurality of generally radially disposed blades 42 on the turbine wheel are positioned between the plurality of reversing blades 62 and the louver 28 and are configured to reverse the direction of swirl of fluid flowing from between the first plurality of blades 42 on the periphery of the turbine wheel. A second plurality of generally radially disposed blades 64 on the periphery of the turbine wheel are preferably positioned closely adjacent to the plurality of reversing blades 62. The reversing blades 62 are positioned between the first plurality of generally radially disposed blades 42 and the second plurality of generally radially disposed blades 64. The second plurality of generally radially disposed blades 64 on the periphery of the turbine wheel have a shape to reverse the direction of swirl of fluid flowing from between the reversing blades 62.

In one aspect, the invention provides an improvement to a process in which a flow of gas is introduced into the turbine case through a plurality of peripherally spaced passages formed by an end wall of the turbine case in which the passages open through the end wall of the case in a direction generally parallel to the turbine shaft. The improvement is provided by flowing the gas from the outlets of the passages into an arcuately shaped housing mounted in covering relationship with the outlets, and thence through a louver for impingement on the periphery of the turbine wheel. The gas is preferably directed by the louver for swirling flow impingement on the periphery of said turbine wheel, and most preferably with both axial and circumferential velocity components. The invention can be carried out in the above-described apparatus.

In a further embodiment of the invention, there is provided a method for modifying a steam turbine of the type which incorporates a turbine case defining a plurality of passages having outlets opening through an inside end wall of the turbine case in a direction generally parallel to the turbine shaft, with nozzles positioned over the outlets to direct steam against the periphery of the turbine wheel. To perform the modification, the nozzles are removed, an arcuately shaped housing is positioned in covering relationship with the outlets, and an arcuately shaped louver is positioned so as to form an end wall of the housing. The louver has a plurality of vanes to direct the steam against the periphery of the turbine wheel to cause rotation of the turbine shaft and the housing forms a confined steam flow path from the outlets to the louver.

The method makes possible the use of a high efficiency bolted-in nozzle plate design. The design hinges upon a part called the nozzle adapter. The adapter is preferably located and secured by using the existing threaded holes originally intended for the individual pipe assemblies. A nozzle plate appropriately designed for the existing blading is then preferably bolted into the adapter, although the turbine blading can be also modified if desired. Fabrication of the adapter is facilitated by employing a CNC milling machine to measure the locations of the ports through the end wall of the turbine case and machining matching passages through the bottom wall 44 of the housing to match.

Calculated Example

It was proposed to modify a Terry Turbine as shown in FIG. 1 to a design as shown in FIG. 2. Theoretical design calculations showed a decrease in steam consumption from 40.2 lbm/hph to 34.4 lbm/hph, while producing 1500 hp. The original power rating was 600 hp. Due to the substantial increase in the power requirement, it was necessary to redesign all of the downstream turbine blading. This, however, would not be typical of most jobs.

While certain preferred embodiments of the invention have been described herein, the invention is not to be construed as being so limited, except to the extent that such limitations are found in the claims.

What is claimed is:

1. In a turbine comprising a turbine case having a first end wall, a second end wall, and a peripheral side wall connecting the first end wall and the second end wall, said turbine case defining a turbine chamber, a turbine shaft rotatably mounted in said turbine case and extending between the first end wall and the second end wall, said turbine shaft having a longitudinal axis, a turbine wheel attached to the turbine shaft and extending radially therefrom, said turbine wheel being positioned in the turbine chamber between the first end wall and the second end wall, said turbine wheel having a turbine wheel periphery which is positioned adjacent to the peripheral sidewall of the turbine case, wherein said turbine case defines a plurality of peripherally spaced apart inlet ports opening through the first end wall to a location in the turbine chamber which is adjacent to the peripheral sidewall of the turbine case, said inlet ports opening into the turbine chamber in a direction which is parallel to the longitudinal axis of the turbine shaft, the improvement comprising an arcuately shaped louver for directing fluid against the periphery of the turbine wheel so as to cause rotation of the turbine wheel, and an adapter housing extending from the arcuately shaped louver to the first end wall of the turbine case to locate the arcuately shaped louver and form a fluid flow path from the inlet ports to the arcuately shaped louver, wherein the periphery of the turbine wheel is formed by a first plurality of generally radially disposed blades positioned to pass closely adjacent to the arcuately shaped louver during rotation of the turbine wheel so as to catch the force of the fluid exiting the arcuately shaped louver and rotate the turbine wheel, wherein the arcuately shaped louver directs a fluid flow into the turbine chamber with a whirling component around the longitudinal axis of the turbine chamber, wherein the arcuately shaped louver directs fluid flow into the turbine chamber with a longitudinal component which is parallel to the longitudinal axis of the turbine chamber, and wherein the adapter housing comprises an arcuately shaped trough having a bottom end wall attached to the first end wall of the turbine case and positioned in covering relationship with the plurality of inlet ports, and a pair of arcuately shaped trough side walls extending from the bottom end wall to the arcuately shaped louver, wherein said inlet ports open into a chamber defined by the bottom end wall, the side walls and the louver, said chamber forming the fluid flow path from the inlet ports to the arcuately shaped louver.

2. A turbine as in claim 1 wherein the louver comprises an arcuately shaped plate which defines an arcuately shaped slot and a plurality of airfoil blades mounted across the slot, the plate being connected to the arcuately shaped trough side walls and the plurality of airfoil blades extending generally radially across the slot so as to define nozzles for fluid passage between the blades.

3. A turbine as in claim 2 wherein the first plurality of blades on the periphery of the turbine wheel is configured to reverse a direction of swirl of fluid flowing from the nozzles.

4. A turbine as in claim 3 further comprising a plurality of reversing blades extending generally radially inwardly from the peripheral wall of the turbine case and positioned closely adjacent to the first plurality of generally radially disposed blades on the periphery of the turbine wheel, the first plurality of generally radially disposed blades on the turbine wheel being positioned between the plurality of reversing blades and the louver and being configured to reverse the direction of swirl of fluid flowing from between the first plurality of blades on the periphery of the turbine wheel;

a second plurality of generally radially disposed blades on the periphery of the turbine wheel positioned closely adjacent to the plurality of reversing blades, wherein the reversing blades are positioned between the first plurality of generally radially disposed blades and the second plurality of generally radially disposed blades, wherein the second plurality of generally radially disposed blades on the periphery of the turbine wheel has a shape to reverse the direction of swirl of fluid flowing from between the reversing blades.

* * * * *